United States Patent [19]

Paton et al.

[11] Patent Number: 4,761,187

[45] Date of Patent: Aug. 2, 1988

[54] METHOD OF IMPROVING STRESS CORROSION RESISTANCE OF ALLOYS

[75] Inventors: Neil E. Paton, Thousand Oaks; Daniel P. Dennies, San Diego; Jesse B. Lumsden, Thousand Oaks; Lillian W. Ng, Glendale, all of Calif.

[73] Assignee: Rockwell International Corporation, El Segundo, Calif.

[21] Appl. No.: 900,196

[22] Filed: Aug. 25, 1986

[51] Int. Cl.[4] ..... C22C 33/00

[52] U.S. Cl. ..... 148/3; 420/35; 420/82; 420/100; 420/129

[58] Field of Search ..... 420/35, 82, 100, 129; 148/3

[56] References Cited

U.S. PATENT DOCUMENTS 4,305,755 12/1981 Wilde ..... 420/82

OTHER PUBLICATIONS

*Metal Progress*, 1978 Metal Progress Databook, Mid--Jun. 1978, pp. 72-73.

*Primary Examiner*—L. Dewayne Rutledge
*Assistant Examiner*—George Wyszomierski
*Attorney, Agent, or Firm*—H. Fredrick Hamann; Harry B. Field; Clark E. DeLarvin

[57] ABSTRACT

A method of improving the stress corrosion resistance of an alloy comprising heating a martensitic stainless steel to a molten state and incorporating into said molten steel from 0.5 to 2.0 weight percent of an additive selected from the group consisting of platinum, palladium or a mixture thereof.

9 Claims, No Drawings

METHOD OF IMPROVING STRESS CORROSION RESISTANCE OF ALLOYS

STATEMENT OF GOVERNMENT INTEREST

The invention described herein was made in the performance of work under Contract No. NAS8-27980 and is subject to the provisions of Section 305 of the National Aeronautics and Space Act of 1958 (72 Stat. 435; 42 USC 2457).

BACKGROUND OF THE INVENTION

The present invention broadly relates to a method of improving the stress corrosion resistance of high-strength, heat-treatable alloys. It particularly relates to a method of improving the stress corrosion resistance of martensitic stainless steels for use as bearing materials in high speed rotating machinery.

There are many instances in which structures or machines are built where some of the components are in a highly stressed condition. This stress can result in a phenomena generally referred to as stress corrosion which can produce cracks in those components possibly leading to failure of the component. This problem is particular acute in the bearing assemblies used for equipment which operate at high rotational speeds. For example, the turbopumps used with rocket engines can operate at speeds in excess of 100,000 RPM. Obviously in such applications, any bearing failure could result in catastrophic failure of not only the pump but also the engine and the vehicle to which it was attached.

During operation of a pump or other device rotating at high speeds, centrifugal forces act on the inner race of the bearing in a radially outward direction. If such forces become too great, the inner race expands radially moving away from the shaft on which it's mounted toward the outer race and reduce the clearance for the bearings. The reduction in clearance would increase the load on the bearings, cause overheating and possible bearing failure. In a similar manner, any clearance between the inner race and the shaft could result in galling or vibration, either of which also could lead to a failure.

To offset the effect of centrifugal forces, it is customary to size the inside diameter of the inner race slightly smaller than the outside diameter of the shaft upon which it is to be mounted. Assembly generally is accomplished by freezing the shaft to cause it to shrink and optionally heating the bearing to expand it. After the bearing is placed on the shaft and they both return to ambient temperature, the result is a so-called "shrink fit". The amount of shrink, among other things, will have a direct effect on the maximum rotational speed at which the assembly can be operated. The amount of shrink fit also is directly related to the amount of stress that will be placed upon the inner race of the bearing following assembly.

The susceptibility to stress corrosion of the material from which the inner race is formed in turn limits the amount of shrink fit that may be utilized. Obviously, any improvement in the stress corrosion resistance of an alloy would be beneficial in that it would permit a greater amount of shrink fit and allow operation at higher rotational speeds.

OBJECTS OF THE INVENTION

It is an object of the invention to provide a method for improving the stress corrosion resistance of a martensitic stainless steel.

It is another object of the invention to provide a method of producing an improved material for use in bearings intended for operation at high rotational speeds.

It is a particular object of the invention to provide a method for improving the stress corrosion resistance of a 400 series martensitic stainless steel.

These and other objects of the invention will be more apparent from the following detailed description.

SUMMARY OF THE INVENTION

The present invention provides a method of improving the stress corrosion resistance of a martensitic stainless steel alloy. The method comprises heating such an alloy to a molten state and incorporating therein an additive selected from the group consisting of platinum, palladium and mixtures thereof. The additive is incorporated into the alloy is an amount of from 0.5 to 2 weight percent and preferably in an amount of from about 0.75 to 1 weight percent based on the total weight of alloy and additive.

The preferred alloys for treatment in accordance with the present invention are those designated by the American Iron and Steel Institute (AISI) as the 400 series stainless steel alloys. It also is preferred for reasons that will be discussed more fully later that the alloy be essentially free of the elements vanadium and molybdenum. By essentially free, it is meant that the alloy and additive should contain less than a total of about ½ weight percent of those elements. Martensitic stainless steels treated in accordance with the present invention are particularly well suited for use as bearing materials (particularly the inner race) for use in high speed rotating machinery such as turbopumps for rocket engines.

DETAILED DESCRIPTION OF THE INVENTION

There are numerous stainless steel alloys which are suitable for treatment in accordance with the present invention. Typically, suitable stainless steel alloys are characterized in that they are principally comprised of chromium (from about 12 to 18 weight percent) and the balance iron. The martensitic stainless steels are further characterized by a high carbon content, typically from about 0.6 to 1.2 weight percent. In addition, they may also contain relatively minor amounts of other elements such as less than 1% each of such elements such as manganese, silicon, phosphorous, sulfur, molybdenum, nickel and copper. Generally, the preferred alloys for treatment in accordance with the present invention are those characterized by the American Iron and Steel Institute (AISI) as 400 series high carbon stainless steels.

The method of the present invention comprises heating the selected alloy to the molten state (typically a temperature of from about 2800° to 3000° F.) and then incorporating therein an additive selected from the group consisting of palladium, platinum or a mixture thereof. Preferably, the additive is incorporated in an amount of from about 0.75 to 1 weight percent, the weight percent being based on the total weight of the alloy and the additive. After incorporation of the additive, the alloy is cooled, roughed formed to a desired configuration and heat treated to a selected hardness.

For example, a hardness of at least a C-58 on the Rockwell scale. Thereafter the item can be finish machined to specified tolerances. The finished item, when treated in accordance with the present invention will have a stress corrosion resistance substantially higher than one formed from the base alloy but not treated in accordance with the present invention. Indeed, the stress corrosion resistance of items produced from material treated in accordance with the present invention may be increased by a factor of 10 or more.

To illustrate the efficacy of the present invention, seven samples of two alloys were obtained. Samples of each type of alloy were modified with small additions (0.75–1.0 weight percent) of platinum or palladium. The composition of each alloy is given in Table 1 below.

TABLE 1

| ALLOY/ELEMENT | NOMINAL COMPOSITION (WT. %) | | | | | | | | | | | | |
|---|---|---|---|---|---|---|---|---|---|---|---|---|---|
| | C | Mn | Si | P | Cr | Ni | Mo | Cu | Cb | Pt | Pd | V | Fe |
| A - 440C Control | 1.00 | .36 | .59 | .011 | 16.89 | .34 | .45 | .07 | <.01 | <.01 | <.01 | <.01 | Bal. |
| G - 440C w/1% Pd | 1.00 | .38 | .62 | .011 | 17.33 | .38 | .46 | .07 | <.01 | <.01 | 1.06 | <.01 | Bal. |
| B - CRB-7 Control | 1.10 | .42 | .36 | .011 | 14.75 | .31 | 1.93 | .03 | .31 | <.01 | <.01 | 1.17 | Bal. |
| C - CRB-7 w/.8% Pd | 1.10 | .40 | .37 | .010 | 14.25 | .31 | 1.94 | .03 | .31 | <.01 | .81 | 1.13 | Bal. |
| D - CRB-7 w/1% Pd | 1.10 | .44 | .39 | .012 | 13.99 | .31 | 1.95 | .04 | .31 | <.01 | 1.08 | 1.12 | Bal. |
| E - CRB-7 w/.75% Pt | 1.10 | .40 | .36 | .012 | 14.25 | .31 | 1.86 | .04 | .30 | .75 | <.01 | 1.08 | Bal. |
| H - CRB-7 w/1% Pt | 1.10 | .39 | .39 | .012 | 14.20 | .32 | 1.89 | .03 | .31 | 1.00 | <.01 | 1.13 | Bal. |

The two alloys obtained conformed to the Aerospace Materials Specification AMS 5618 (AISI 440C) and AMS 5900 (CRB-7). A sample bar of each of the sample alloys was machined in a direction transverse to its length to provide test specimens. Each specimen was then heat treated in accordance with the standard procedure for the respective base materials. The heat treatment for each of the two types of alloy are set forth in Tables 2 and 3 below.

TABLE 2

DETAIL REQUIREMENTS FOR HEAT TREATMENT PROCESS 440C CRES

| STEP | TREATMENT |
|---|---|
| 1. | Preheat at 1525 plus or minus 25 F. to equalize temperature. |
| 2. | Austenitize at 1925 plus or minus 25 F. for 30 minutes minimum. |
| 3. | Quench in an oil medium at a temperature not to exceed 900 F. |
| 4. | Cool in air to room temperature. |
| 5. | Stabilize at below −100 F. in an acceptable medium (typically dry ice and alcohol or liquid nitrogen) for 30 minutes minimum. |
| 6. | Warm in air to room temperature. |
| 7. | Temper at 325 (plus 25, minus 10) F. for 60 minutes minimum. |
| 8. | Cool in air to room temperature. |
| 9. | Stabilize at −320 F. in $LN_2$ for 30 minutes minimum. |
| 10. | Warm in air to room temperature. |
| 11. | Temper at 325 (plus 25, minus 10) F. for 60 minutes minimum. |
| 12. | Cool in air to room temperature. |

Time Tolerance: The bearing details shall be subjected to a time tolerance of two hours or less during heat treatment between Steps 3 and 5.

Hardness Test: A hardness test shall be performed on item surfaces in accordance with ASTM E18 to determine conformance with the hardness requirement. The hardness of the material after final tempering shall be within the range of Rockwell C 58–63. Failure to meet the hardness requirement shall be cause for rejection.

Normal hardnesses were obtained for each alloy, namely a Rockwell C 58–64.

TABLE 3

DETAIL REQUIREMENTS FOR HEAT TREATMENT PROCESS CRB-7

| STEP | TREATMENT |
|---|---|
| 1. | Preheat at 1500 plus or minus 25 F. to equalize temperature. |
| 2. | Austenitize at 2100 plus or minus 25 F. for 30 minutes minimum. |
| 3. | Quench in an oil medium at a temperature not to exceed 900 F. |
| 4. | Cool in air to room temperature. |
| 5. | Stress relieve at 300 plus or minus 25 F. for 60 plus or minus 5 minutes. |
| 6. | Cool in air to room temperature. |
| 7. | Stabilize at −320 F. in $LN_2$ for 30 minutes minimum. |
| 8. | Warm in air to room temperature. |
| 9. | Temper at 975 plus or minus 15 F. for 2 hours plus or minus 15 minutes. |
| 10. | Cool in air to room temperature. |
| 11. | Repeat temper cycle in steps 9 and 10. |

Time Tolerance: The bearing details shall be subjected to a time tolerance of two hours or less during heat treatment as follows:

| | |
|---|---|
| Between Steps 3 and 6 | for CRB7 |
| Between Steps 6 and 8 | |

Hardness Test: A hardness test shall be performed on item surfaces in accordance with ASTM E18 to determine conformance with the hardness requirement. The hardness of the material after final tempering shall be within the range of Rockwell C 61–64. Failure to meet the hardness requirement shall be cause for rejection.

Normal hardnesses were obtained for each alloy, namely a Rockwell C 62–65.

Each specimen was then tested in accordance with an alternate immersion stress corrosion test established by the American Society for Testing and Materials (ASTM G44) to rank the effectiveness of the alloying additions. Broadly, each test specimen was loaded to fifty thousand pounds per square inch and continuously immersed in a 3.5 weight percent NaCl solution for ten minutes followed by air drying for 50 minutes which constituted one cycle. The cycle is repeated continuously for 24 hours a day until the specimen fails. Six tests were run on each of the seven types of alloy tested.

Due to the inherent data scatter in stress corrosion cracking tests, data are plotted as Weibull distributions. The $B_{10}$, $B_{50}$ and the lower and upper limits of the 90% confidence of the $B_{10}$ life are shown in Table 4. Since stress corrosion cracking resistance is critical in bearing applications, the lower limit of the 90% confidence on the $B_{10}$ life (90% confidence that at $B_{10}$ number of days no more than 10% of the population will fail) are compared.

TABLE 4

SCC TEST RESULTS

| MATERIAL | $B_{10}$ (Days) | $B_{50}$ (Days) | 90% CONF. LIMITS, $B_{10}$ (Days) LOWER | UPPER | SAMPLE SIZE |
|---|---|---|---|---|---|
| 440C BASELINE | 1.2 | 7.6 | 0.5 | 4.0 | 10 |
| 440C W/1% Pd | 10.5 | 30.4 | 5.4 | 24.0 | 6 |
| CRB-7 BASELINE | 4.2 | 11.6 | 2.3 | 9.3 | 6 |
| CRB-7 W/1% Pd | 0.56 | 2.2 | 0.24 | 1.6 | 6 |
| CRB-7 W/1% Pt | 0.61 | 2.6 | 0.25 | 1.9 | 6 |
| CRB-7 W/.8% Pd | 0.56 | 2.1 | 0.25 | 1.6 | 6 |
| CRB-7 W/.75% Pt | 2.6 | 9.4 | 1.2 | 7.1 | 6 |

From the results shown in Table 4 it is seen that platinum/paladium alloying additions appear detrimental to the stress corrosion cracking resistance of CRB-7. However, it is also seen that the 1% paladium addition improves the stress corrosion cracking resistance of 440C compared to the controlled 440C specimen. Comparing the lower limit of the $B_{10}$ life, it is seen that there is a factor of ten improvement in the life of the paladium modified 440C.

With regard to the CRB-7, the inventors do not know with certainty nor do they wish to be bound by a particular theory, however it is believed that the failure to obtain enhanced corrosion resistance with this material was the result of the high percentage of the elements vanadium and molybdenum present in that alloy. Accordingly, the preferred materials for use in accordance with the present invention should be substantially free of those elements. Specifically, it is preferred that the material or alloy to be treated contain less than a total of one weight percent of vanadium and molybdenum and preferably less than about a one half weight percent of those elements.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A method of improving the stress corrosion resistance of an alloy comprising:

heating a martensitic stainless steel to a molten state and incorporating into said molten steel from 0.5 to 2.0 weight percent of an additive selected from the group consisting of platinum, palladium or a mixture thereof.

2. A method of improving the stress corrosion resistance of a 400 series martensitic stainless steel alloy comprising;

heating said alloy to a molten state and incorporating therein from 0.5 to 2.0 weight percent of an additive selected from the group consisting of platinum, palladium and mixtures thereof.

3. The method of claim 1 wherein said stainless steel is a 440C series stainless steel.

4. The method of claim 2 wherein said steel is essentially free of vanadium and molybdenum.

5. The method of claim 4 wherein said steel contains less than a total of one half weight percent of the elements vanadium and molybdenum.

6. The method of claim 2 wherein said stainless steel is a 440C series stainless steel and said selected additive is palladium.

7. The method of claim 6 wherein said palladium is present in an amount of from 0.75 to 1 weight percent.

8. The method of claim 4 wherein said additive is present in an amount of from 0.75 to 1 weight percent.

9. The method of claim 2 further including the steps of forming said alloy into a bearing race and heat treating same for use in a turbopump.

* * * * *